US005186674A

United States Patent [19]

Beckhusen et al.

[11] Patent Number: 5,186,674

[45] Date of Patent: Feb. 16, 1993

[54] TOY PAINT APPLICATORS

[75] Inventors: Gerard F. Beckhusen, East Aurora; Gail S. Mowrer, Elma, both of N.Y.

[73] Assignee: Fisher-Price, Inc., East Aurora, N.Y.

[21] Appl. No.: 711,817

[22] Filed: Jun. 7, 1991

[51] Int. Cl.[5] ..... A63H 33/30; A63H 17/44; B05C 1/00; A63J 3/00

[52] U.S. Cl. ..... 446/144; 446/483; 15/230.11; 472/72

[58] Field of Search ..... 446/144, 145, 227, 236, 446/237, 267, 304, 305, 475, 483, 489; 15/230.11, 159 R, 160 N; 472/71, 72, 57

[56] References Cited

U.S. PATENT DOCUMENTS 783,203 2/1905 Morrocks ..... 472/72
2,694,571 11/1954 Reynolds et al. ..... 472/72
2,886,316 5/1959 Ayala ..... 446/267
3,245,174 4/1966 Gardel et al. ..... 446/267
3,314,677 4/1967 Ayala ..... 472/72
4,159,594 7/1979 Reiner et al. ..... 446/304 X

*Primary Examiner*—D. Neal Muir
*Attorney, Agent, or Firm*—Cumpston & Shaw

[57] ABSTRACT

Toy paint applicators for creating the illusion of picking up paint and applying it to a surface. The present invention includes a toy paint applicator having a handle; a simulated paint receiving element having a translucent portion for simulating a paint receiving area of the applicator; a color imparting member movably disposed with respect to the translucent portion for movement between a coloring position for simulating the presence of paint on the paint receiving element, and a noncoloring position for simulating the absence of paint on the paint receiving element to create the effect of picking up paint and applying it to a surface. The toy paint applicator includes a first preferred embodiment of a paint roller for creating the illusion of applying paint to and from the roller and a second preferred embodiment of a paint brush.

16 Claims, 5 Drawing Sheets

TOY PAINT APPLICATORS

The present invention relates to toy paint applicators and, more particularly, to a toy paint applicators for simulating the effect of picking up paint and applying it to a surface.

BACKGROUND OF THE INVENTION

Many effective learning tools for children simulate products used by adults. Popular children's toys include simulated medical and military equipment, and many household items such as ovens and ranges. Toy tool sets including toy hammers, screwdrivers and saws are also popular.

While many adults frequently paint, the fluid nature of paint, and its permanence upon unintended contact with furniture or floors, discourages participation by children. Therefore, a need exists for toy paint applicators which provide the child with the illusion of withdrawing paint from a container and applying the paint to a play surface.

SUMMARY OF THE INVENTION

The present invention includes a toy paint applicator having a handle; a simulated paint receiving element having a translucent portion for simulating a paint receiving area of the applicator; a color imparting means movably disposed with respect to the translucent portion for movement between a coloring position for simulating the presence of paint on the paint receiving element, and a noncoloring position for simulating the absence of paint on the paint receiving element to create the effect of picking up paint and applying it to a surface. The toy paint applicator includes a first preferred embodiment of a paint roller for creating the illusion of applying paint to and from the roller and a second preferred embodiment of a paint brush.

The toy paint roller includes a handle and a roller assembly mounted to handle. The handle includes a pair of spaced apart arms for mounting the roller assembly. The roller assembly includes a driver; a cover cylinder; a transition cylinder; and a color element.

The driver includes a peripheral drive wheel for contacting a play surface and an inner drive sleeve. The color member has a first end affixed to the drive sleeve and a second free end. The transition cylinder is affixed relative to the handle and and concentrically oriented about drive sleeve. The transition cylinder includes a longitudinal slot sized to receive a portion of the color member. The cover cylinder is rotatably mounted to the handle concentrically oriented about the transition cylinder and the drive sleeve.

The cover cylinder includes a inwardly projecting tab, the driver includes a radially extending pickup and retract fingers, and the transition cylinder includes a stop block. The tab, fingers, and stop block cooperate to limit rotation of the driver relative to the transition cylinder so as to control displacement of the color member relative to the slot in the transition cylinder.

Upon rotation of the driver in a first direction, the driver rotates the color member so that the free end passes through the slot of the transition cylinder and is disposed between the outside the transition cylinder and the inside of the cover cylinder. Upon a sufficient rotation of the driver to dispose the color member substantially about the transition cylinder and between the transition cylinder and the cover cylinder, the fingers, tab and stop block cooperate to prevent further rotation.

Upon rotation of the driver in the second opposite direction, the driver withdraws, or retracts, the color member through the slot so as to be disposed between the transition cylinder and the drive sleeve, thereby creating the illusion of removal of paint from the roller. When the color member is completely withdrawn, or retracted within the transition cylinder. The fingers, tab and stop block cooperate to prevent further rotation.

The second preferred embodiment includes a toy paint brush for creating an illusion of paint transfer to and from the brush. The toy paint brush includes a handle, a translucent member and a color member. The translucent member extends from the handle and is preferably configured to represent a plurality of bristles. The color member is slidably disposed relative to the handle between a first and a second position. In the first position, the color member is proximally disposed to the translucent member such that the coloring of the color member appears in the translucent member, thereby creating the illusion of paint in the brush. In the second position the color member is disposed within the handle remote from the translucent member so that the color member is hidden or occluded by the handle. The translucent member thereby exhibits its neutral color.

Preferably, the color member is disposed between the first and second positions in response to orientation of the brush, such that as the brush is dipped into a "reservoir of paint", gravity draws the the color member to the first position. Upon reorientation of the brush such that the translucent member is disposed above the handle, the color member slides back into the handle so that the coloring of the color member is no longer visible in the translucent member.

DETAILED DESCRIPTION OF THE PREFERRED EMBODIMENT

The toy paint applicator of the present invention is described in a preferred embodiment of a toy paint roller FIGS. 1-7, and a toy paint brush FIGS. 8-12.

Figure 2:
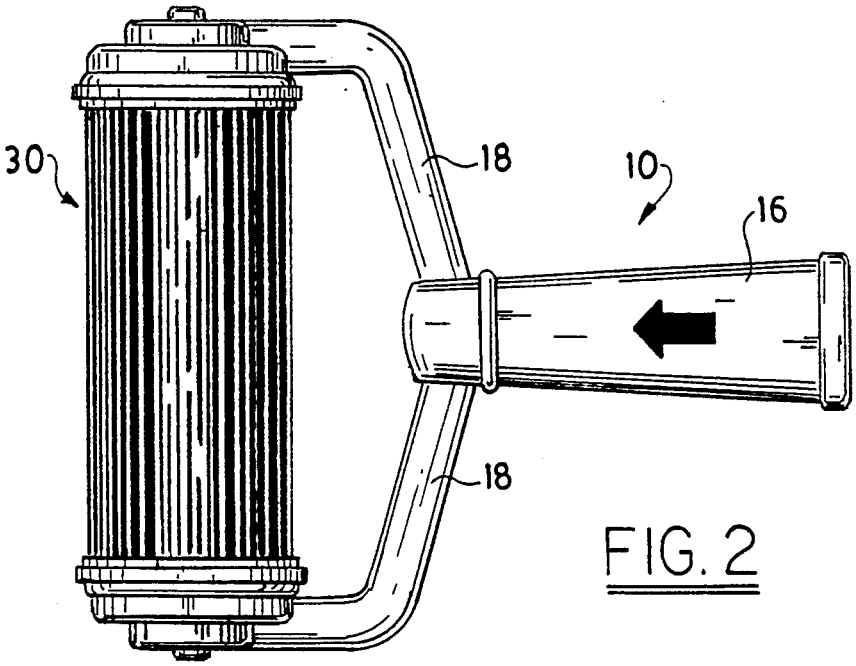
FIG. 2 is a top plane view of the first embodiment of the applicator showing "paint" on the roller as the roller is disposed in a first direction.
Figure 9:
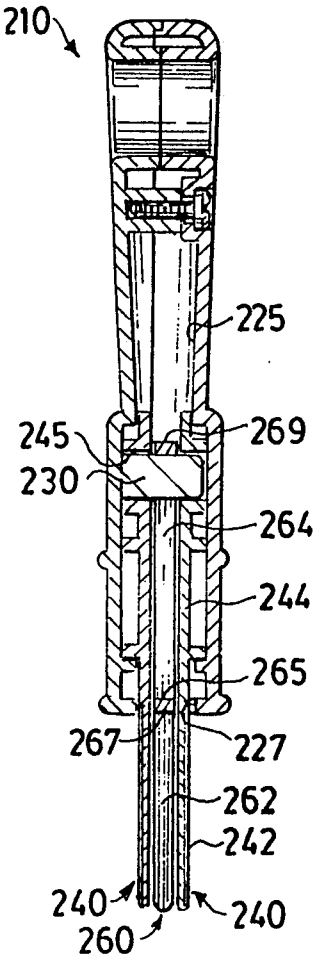
FIG. 9 cross sectional view of the paint brush of the second embodiment in the first position taken along line 9—9 of FIG. 8.

Referring to FIGS. 2 and 9, the toy paint applicator includes a handle 16 in the first embodiment, 220 in the second embodiment; a simulated paint receiving element having a translucent portion for simulating a paint receiving area of the applicator, 60 in the first embodiment, 240 in the second embodiment; and a color imparting means, 70 in the first embodiment and 260 in the second embodiment.

In the first preferred embodiment the toy paint applicator is a toy paint roller 10.

Figure 1:
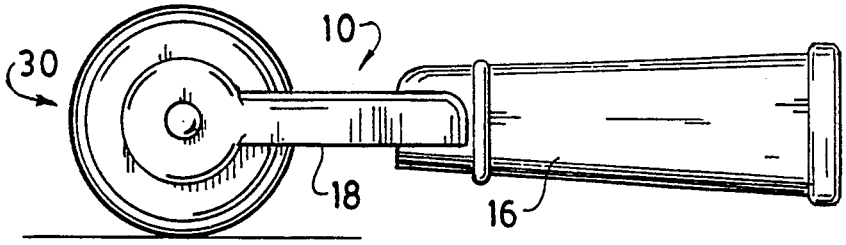
FIG. 1 is a side elevational view of the first embodiment of the applicator showing a paint roller in contact with a support surface.
Figure 3:
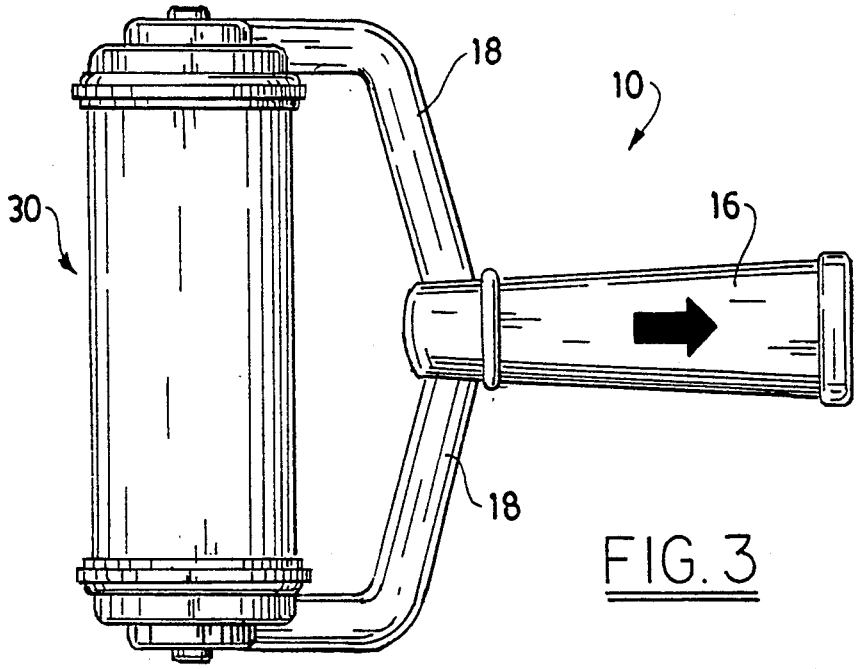
FIG. 3 is a top plane view of the first embodiment of the applicator showing rotation of the brush in the second direction with no paint on the roller.

Referring to FIGS. 1-3, the toy paint roller 10 of the present invention includes a handle 16 having a pair of spaced apart arms 18 and a roller assembly 30 disposed between the arms 18. As shown in FIG. 2, upon pushing the paint roller 10 in a first direction the roller assembly 30 appears to pickup paint. Referring to FIG. 3, upon rotation of the paint roller 10 in the opposing direction, the roller assembly 30 appears to dispense paint.

Figure 5:
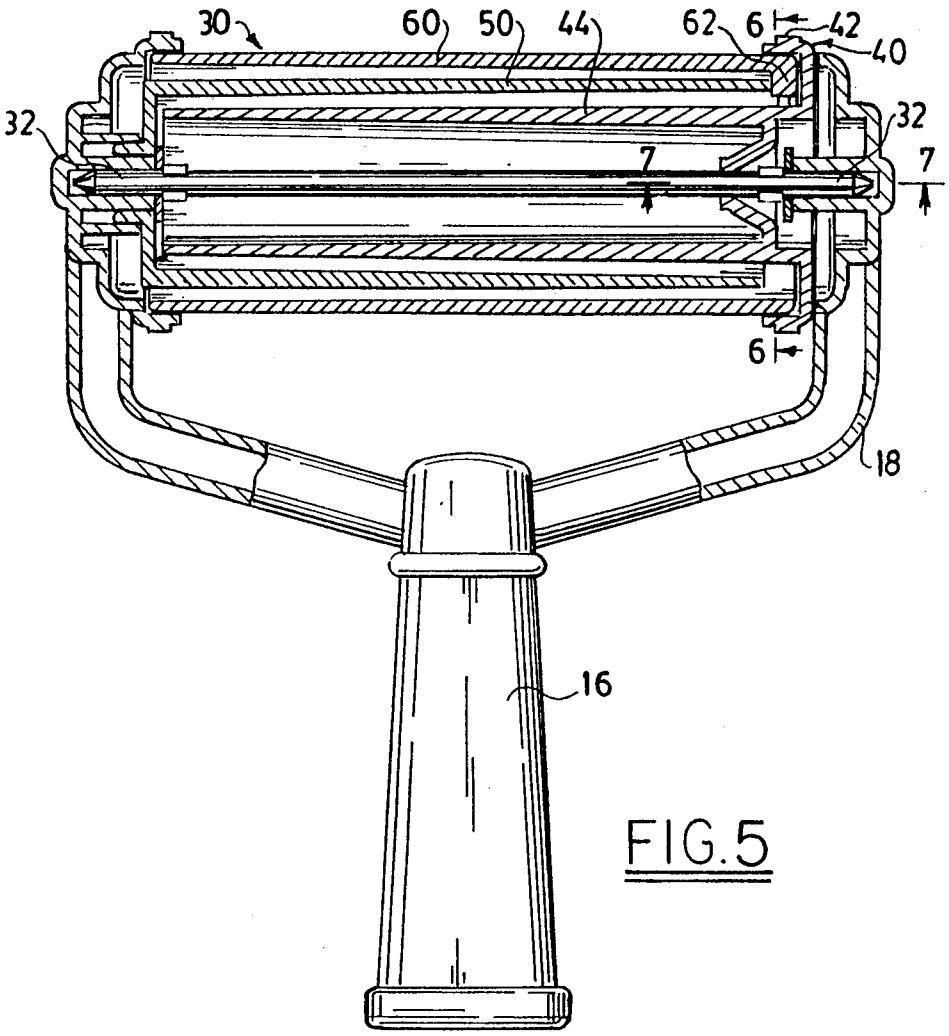
FIG. 5 is a partial cross sectional view of the first embodiment of the applicator taken along lines 5—5 of FIG. 4.

As shown in FIG. 5, an axle 32 extends between the arms 18 and is affixed with respect to the arms. Alternatively, the axle 32 may be rotatably mounted (not shown) to the handle 16 for rotation relative to the handle. The handle 16 may be formed of polypropylene.

Figure 4:
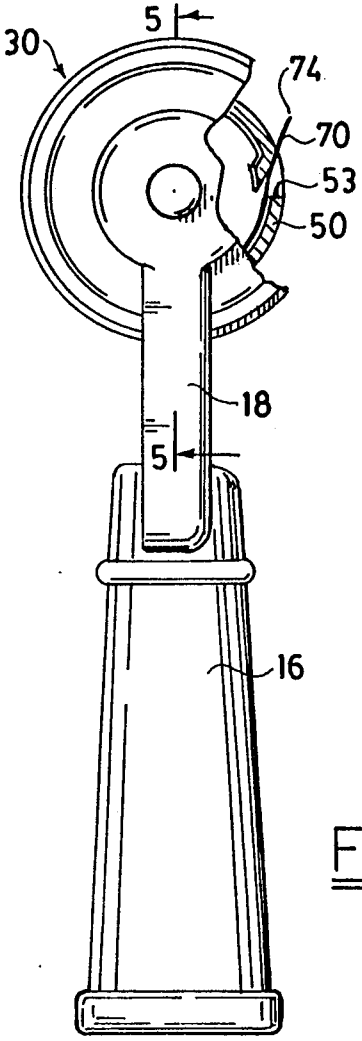
FIG. 4 is a side elevational view of the paint roller of the first embodiment including a partial cross sectional view of the roller mechanism.

Referring to FIGS. 4 and 5, the roller assembly 30 includes a driver 40, transition cylinder 50, cover cylinder 60, and color member 70.

Figure 6:
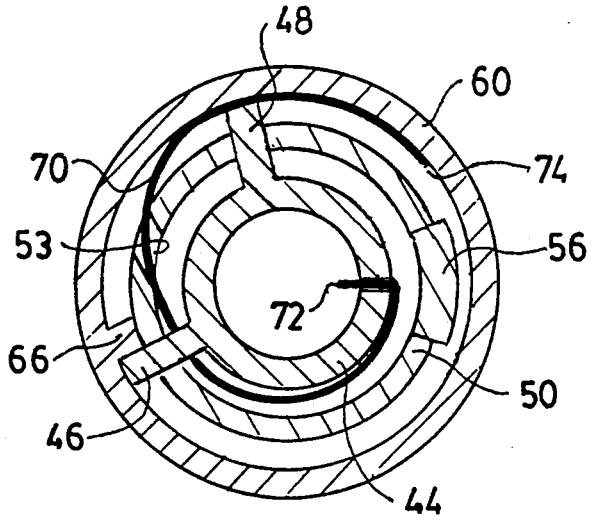
FIG. 6 is a cross sectional view taken of the first embodiment of the applicator along lines 6—6 of FIG. 5.

The driver 40 is concentrically mounted about the axle 32 and rotatable relative to the arms 18. The driver 40 includes a peripheral drive wheel 42 and inner driver sleeve 44. The drive wheel 42 and drive sleeve 44 may be integrally formed and joined at an end of the sleeve such that the drive wheel is transverse to the longitudinal axis of the sleeve. Referring to FIG. 6, the driver 40 includes a pickup finger 46 and a retract finger 48 extending radially from the inner drive sleeve. Preferably, the fingers 46,48 are disposed approximately 120° apart and are formed on the drive wheel 42. The driver 40 may be formed of linear polyethylene.

Figure 7:
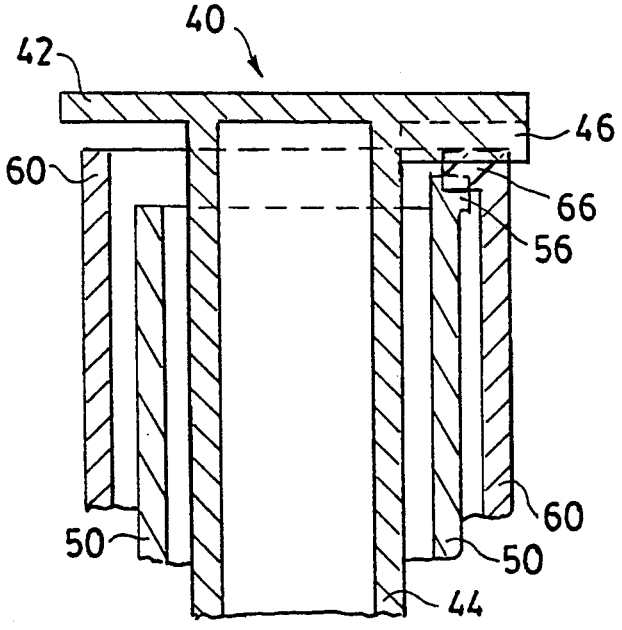
FIG. 7 is a schematic view of the rolling limitation mechanism of the first embodiment of the applicator taken along lines 7—7 of FIG. 5.
Figure 10:
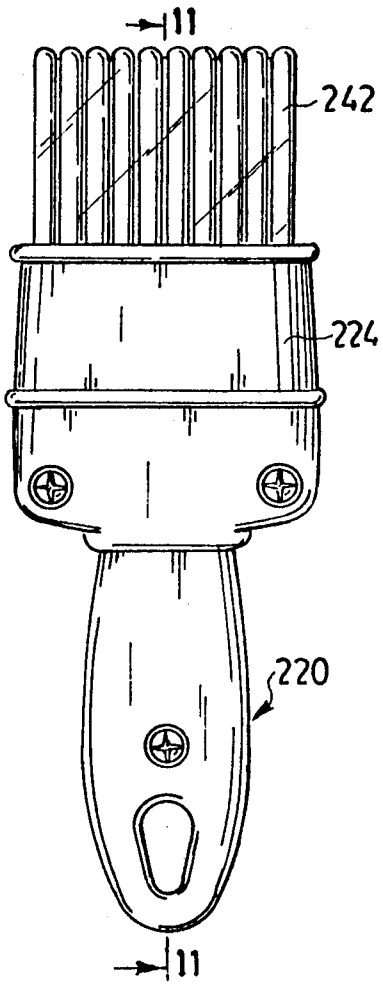
FIG. 10 is a front elevational view of the paint brush of the second embodiment in the second position.

Referring to FIGS. 5, 6 and 7, the transition cylinder 50 is disposed between the arms 18 so as to concentrically enclose the drive sleeve 44. The circumference of the transition cylinder 50 is greater than the inner sleeve 44, but less than the drive wheel 42. The transition cylinder 50 is affixed with respect the handle 16, and includes a longitudinal slot 53 as shown in FIGS. 4 and 6. The slot 53 extends nonradially through a wall of the transition cylinder 50 to connect the interior of the cylinder to the exterior of the cylinder. The transition cylinder 50 is opaque and preferably white. The transition cylinder 50 is formed of an opaque plastic. Referring to FIG. 6, one end of the transition cylinder 50 includes a stop block 56 extending radially from the periphery of the cylinder to subtend an arcuate angle of approximately 55°. The transition cylinder 50 is formed of polypropylene.

The cover cylinder 60 is concentrically mounted about the axle 32 between the arms 18 so as to enclose the transition cylinder 50 and the drive sleeve 44. The outer circumference of the cover cylinder 60 is less than the circumference of the drive wheel 42, and the inner circumference of the cover cylinder is greater than the circumference of the transition cylinder 50. The cover cylinder 60 is a transparent member, and includes an inwardly projecting tab 66 proximal to one end. The tab 66 extends a sufficient distance to contact the stop block 56 and fingers 46,48. The cover cylinder may be formed of a clear plastic such as medium impact butadiene polystyrene: the cover cylinder 60 provides a simulated paint receiving element having a translucent portion for simulating a paint receiving area.

As shown in FIG. 7, the fingers 46 of the driver 40 selectively contact the tab 66, and the tab selectively contacts the stop block 56. Preferably, the end of the transition cylinder 50 which includes the stop block 56 is separated from the drive wheel 42 and fingers 46,48 by a sufficient distance so that the tab 66 is disposed intermediate of the fingers and the stop block. As the fingers 46,48 cannot directly contact the stop block 56, the tab 66 acts as a transition piece in selectively transmitting rotation of the driver 40 to the cover cylinder 60.

Although the angles between the fingers 46,48 and the subtended angle of the stop block 56 are specifically recited, the angles may be changed in view of design considerations while performing the same functions.

The color member 70 has a first end 72 affixed to the drive sleeve 44 as shown in FIG. 6, and a second free end 74 sized to pass through the slot 53 in the transition cylinder 50. The first end 72 may be attached to the drive sleeve 44 by adhesives or a friction fit as well known in the art. The color member 70 has the color of the "paint" to be associated with the roller assembly 30. The color member provides color imparting means movable between a first and second position. Preferably, the color member 70 is a resilient flexible material such as Mylar ®. The color member 70 and the spacing between the cover cylinder 60 and transition cylinder 50, and the spacing between the drive sleeve 44 and transition cylinder 50 are sized so that at least one revolution of the color member may be disposed between cover and transition cylinder, and the drive sleeve 44 and transition cylinder 50.

Referring to FIGS. 2, 3, 4 and 6, the creation of the illusion of paint on the paint roller 10 is provided by the displacement of the color member 70 through the slot 53 of the transition cylinder 50 so as to be disposed between the transition cylinder and cover cylinder 60. As the color member 70 is withdrawn into the transition cylinder 50 to be disposed between the drive sleeve 44 and the transition cylinder, the opaque transition cylinder occludes the color member, thereby creating the illusion of removal of paint from the paint roller 10.

Upon motion of the paint roller 10 in the direction shown in FIG. 2, the drive wheel 42 contacts play surface 6 as shown in FIG. 1, and rotates in a first, pickup direction. The rotation of the drive wheel 42 rotates the drive sleeve 44 to rotate the color member 70. The resilience of the color member 70 causes the free end 74 to be urged against the inside of the transition cylinder 50 when the color member is completely retracted. As the driver 40 rotates the color member 70, the free end 74 slips into the slot 53 and emerges between the cover cylinder 60 and transition cylinder 50. Continued rotation of the driver 40 further displaces the free end 74 in the annulus between the transition and cover cylinder 50,60. Continued rotation of the driver 40 disposes more of the color member 70 between the transition cylinder 50 and the cover cylinder 60. As the driver 40 further rotates, the pickup finger 46 of the driver contacts the inwardly projecting tab 66 of the cover cylinder 60. The driver 40 and cover cylinder 60 then rotate together until the tab 66 contacts one end of the stop block 56 thereby preventing further rotation. The pickup finger 46, tab 66 and stop block 56 are aligned so that as the tab contacts the stop block, the color member extends approximately 360° about the transition cylinder 50. The paint roller 10 thereby appears to "pickup" paint.

Upon rotation of the paint roller 10 in the second direction shown in FIG. 3, the color member 70 is rewound about the inner sleeve 44 thereby retracting the color member through the slot 53. After the driver 40 is rotated approximately 240° from full rotation in the first pickup direction, the retract finger 48 contacts the tab 66, and thereby rotates the cover cylinder 60. The driver 40 and cover cylinder 60 rotate until the color member 70 is completely withdrawn into the transition cylinder 50 and the tab 66 contacts the opposing end of the stop block 56 thereby preventing further rotation. The color member 70 has then been completely withdrawn into the transition cylinder 50 and is occluded by the transition cylinder so that the paint roller 10 appears empty.

Figure 8:
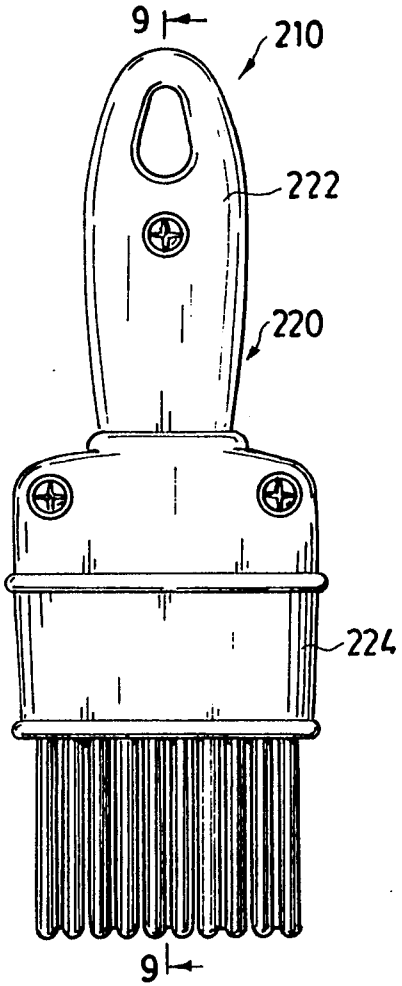
FIG. 8 is a front elevational view of the second embodiment of the applicator showing a toy paint brush in the first position.

Referring to FIGS. 8 and 9, the paint brush 210 includes a handle 220, translucent members 240 and a color member 260.

As shown in FIGS. 8 and 9, the handle 220 includes a gripping portion 222 and a ferrule portion 224. The handle 220 defines a longitudinal recess 225 sized to receive the color member 260. The recess 225 is defined by an opening 227 in the ferrule portion. The handle 20 includes a guide tab 230 projecting inwardly into the longitudinal recess 225.

Preferably, the translucent members 240 are interchangeable, and permanently affixed relative to the handle 220. The translucent members 240 are parallel and extend from opposing sides of the the opening 227. The translucent members 240 exhibit a neutral color when isolated and transmit the color of an object proximal or close to the translucent member. Preferably the translucent members 40 are formed of clear flexible plastic, such as thermoplastic rubber. The translucent members 240 define a simulated paint receiving element having a translucent portion simulating a paint receiving area.

Figure 11:
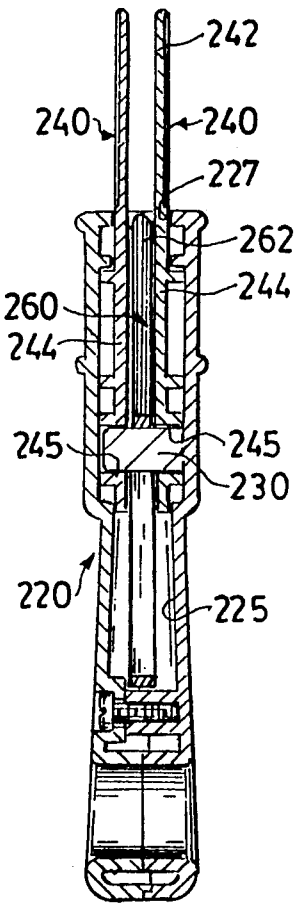
FIG. 11 is a cross sectional view taken along lines 11—11 of FIG. 10 showing the paint brush of the second embodiment in the second position.

Referring to FIGS. 9 and 11, each translucent member 240 includes a retainer portion 244 and a bristle portion 242. The bristle portion is configured to represent bristle groups or individual bristles (not shown). The retainer portion 244 of each translucent member 240 includes an aperture 245 sized to receive the guide tab 230. As seen in FIGS. 9 and 11, the translucent members 240 extend through the opening 227 parallel to the longitudinal recess 225 and terminate at a fixed distance from the handle 220.

Figure 12:
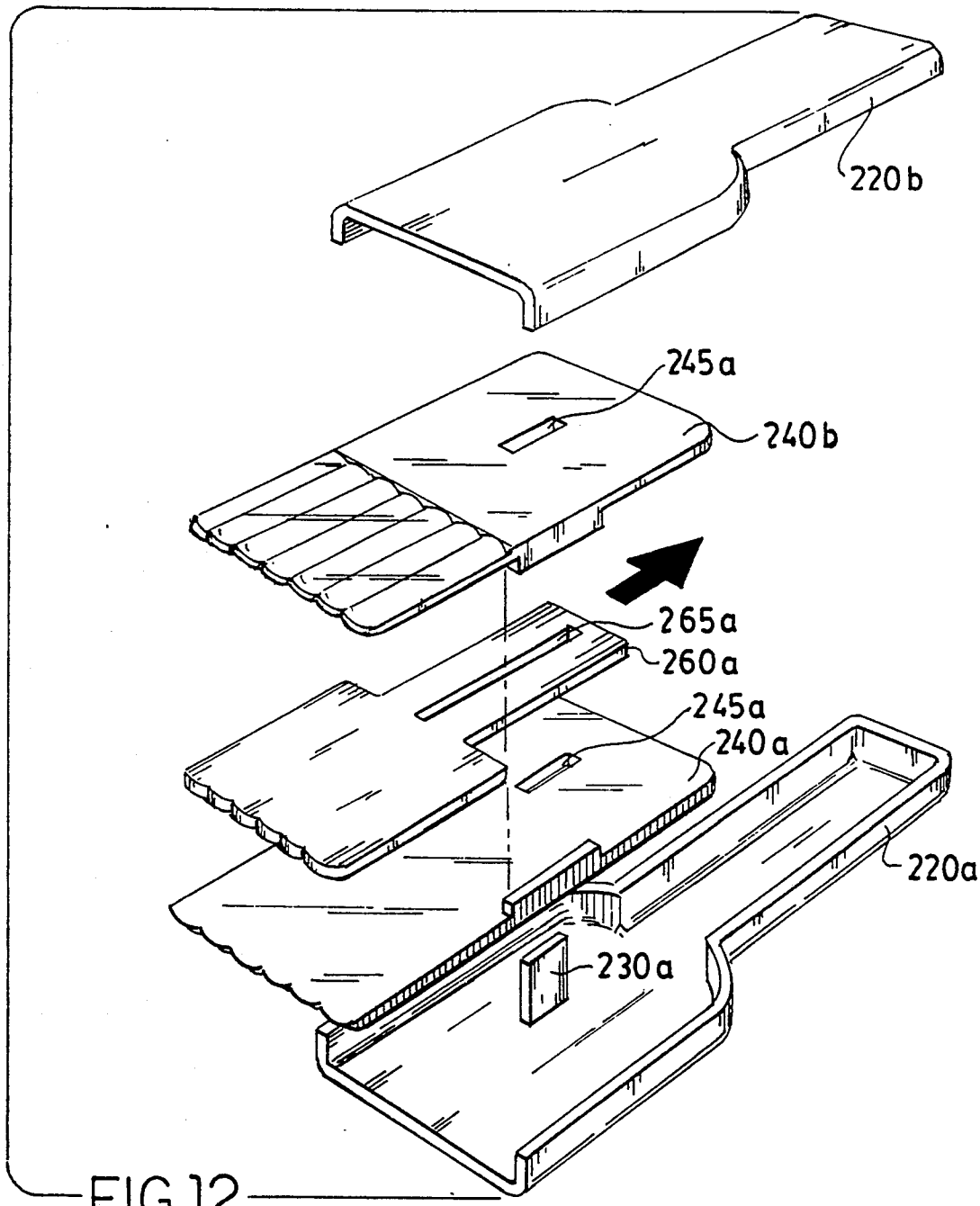
FIG. 12 is an exploded schematic representation of the second embodiment showing the arrangement of the components.

As shown in FIGS. 9, 11 and 12, the color member 260 is disposed between the translucent members 240 and includes a display portion 262 and a coupling portion 264. The coupling portion 264 includes a longitudinal guide channel 265 sized to receive the guide tab 230. The display portion 262 is configured to represent bristles and is colored to represent the color of paint to be associated with the brush 210. The color member 260 is formed of a colored thermoplastic elastomer.

Referring to FIG. 9, in the first position, the display portion 262 of the color member 260 is adjacent to the bristle portion 242 of the translucent members 240. Referring to FIG. 11, in the second position, the display portion 262 of the color member 260 is disposed within the handle 220 such that the display portion is with the recess 225 and distal to the bristle portions 242.

Referring to FIG. 12, the handle is schematically shown as first and second handle halves **220*a* and 220*b* wherein the first handle half 220*a* includes the guide tab 230*a*. One translucent member 240*a* is aligned with the first housing half 220*a* such that the aperture 245*a* receives the guide tab 230*a*. The color member 260*a* is disposed relative on the first translucent member 240*a* such that the guide tab 230*a* is disposed within the guide channel 265*a*. The remaining translucent member 240*b* is disposed over the guide tab 230*a*, such that the guide tab fits within the corresponding aperture. The second handle 220*b* half is disposed over the translucent and color members 240*a,b* and 220*a* and affixed to the first handle half 220*a*** by fasteners known in the art such as adhesives, screws or bolts (not shown).

Upon orientation of the paint brush in the first position, wherein the translucent bristle portions 242 point downward as shown in FIGS. 8 and 9, gravity causes the color member 260 to slide downward such that the guide tab 230 contacts a first end 269 of the guide channel 265 and the display portion 262 is disposed proximal to and between the bristle portions 242. As shown in FIG. 8, the coloring of the display portion 262 is visible through the bristle portions 242. This action of disposing the display portion 262 between the translucent portions 242 is accomplished in the motion similar to dipping the paint brush 210 into a bucket of paint (not shown).

Upon removal of the brush 210 from the bucket of paint (not shown), the color member 260 creates the illusion of the brush 210 being filled with paint. Upon reorientation of the brush 210 to the second position, shown in FIGS. 10 and 11, wherein the translucent members 242 extend above the handle 220, gravity causes the color member 260 to slide into the recess, such that the display portion 262 is substantially occluded by the handle 220. As the color member 260 slides into the handle 220, the translucent members assume the substantially colorless, or neutral appearance thereby creating the illusion of removal of paint from the brush 210.

While a preferred embodiment of the invention has been shown and described with particularity, it will be appreciated that various changes and modifications may suggest themselves to one having ordinary skill in the art upon being apprised of the present invention. It is intended to encompass all such changes and modifications as fall within the scope and spirit of the appended claims.

What is claimed is:

1. A toy paint applicator comprising:

(a) a handle;

(b) a simulated paint receiving element having a translucent portion for simulating a paint receiving area of the applicator; and (c) color imparting means movably disposed with respect to the translucent portion for movement between a coloring position for simulating the presence of paint or the paint receiving element and a noncoloring position for simulating the absence of paint on the paint receiving element to create the effect of picking up paint and applying it to a surface.

2. The toy paint applicator of claim 1, wherein the simulated paint receiving element resembles the bristles of a paint brush.

3. The toy paint applicator of claim 1, wherein the simulated paint receiving element comprises a cylindrical roller.

4. The toy paint applicator of claim 1, wherein the color imparting means resembles the bristles of a paint brush.

5. The toy paint applicator of claim 1, wherein the color imparting means comprises a color sheet having sufficient flexibility to form a substantially cylindrical configuration.

6. A toy paint roller, comprising:

(a) a handle;

(b) an opaque transition cylinder connected to the handle, the transition cylinder having a longitudinal slot connecting an interior of the cylinder to an exterior of the cylinder;

(c) color imparting means having a first end affixed relative to the handle and a second end sized to pass through the slot; and (d) means for selectively moving a portion of the color member through the slot such that the portion of the color member is disposed at the exterior of the transition cylinder.

7. The paint roller of claim 6, further comprising:

(a) a substantially transparent cover cylinder concentrically mounted about the transition cylinder for rotation relative to the transition cylinder.

8. A toy paint roller, comprising:

(a) a handle;

(b) a driver rotatably mounted to the handle for rotation in a pickup direction and an application direction, the driver including a peripheral drive wheel for contacting a play surface and an inner drive sleeve;

(c) a transition cylinder affixed to the handle such that the drive sleeve is within the transition cylinder, the transition cylinder having a longitudinal slot connecting an interior of the transition cylinder and an exterior of the transition cylinder; and (d) a flexible color member having a first end affixed to the drive sleeve and a second end sized to pass through the longitudinal slot;

wherein rotation of the driver in the pickup direction rotates the drive sleeve to dispose a portion of the color member through the longitudinal slot to the exterior of the transition cylinder, and rotation of the driver in the application direction rotates the drive sleeve to withdraw a portion of the color member through the longitudinal slot to the interior of the transition cylinder.

9. The paint roller of claim 8, further comprising means for limiting rotation of driver relative to transition cylinder to preclude retraction of the color member through the slot when the driver rotates in the pickup direction.

10. The paint roller of claim 9, further comprising:

(a) a stop block on the transition cylinder the stop block subtending a portion of a circumference of the transition cylinder;

(b) a cover cylinder connected to the handle such that the drive sleeve and the transition cylinder are within the cover cylinder, the cover cylinder including an inwardly projecting tab sized to contact the stop block; and (c) a radial finger projecting outwardly from the drive sleeve; wherein rotation of the driver in the pickup direction contacts the finger and the tab to rotate the cover cylinder, such that upon sufficient rotation the color member extends substantially about the transition cylinder, and the tab contacts the stop block to preclude further rotation of the driver.

11. A toy paint roller, comprising:

(a) a handle;

(b) an opaque transition cylinder affixed to the handle, the transition cylinder having a longitudinal slot connecting the interior of the cylinder to the exterior of the cylinder;

(c) a drive sleeve concentrically disposed within the transition cylinder (d) a color member having a first end affixed tot he drive sleeve and a second end sized to pass through the slot; and (e) means for selectively disposing a portion of the color member through the slot in response to rotation of the drive sleeve.

12. The toy paint roller of claim 11, further comprising means for precluding withdrawal of the color member through the slot upon rotation of the driver in pickup direction.

13. A toy paint brush, comprising:

(a) a handle;

(b) a translucent simulated paint receiving element extending from the handle;

(c) color imparting means slidably disposed relative to the translucent element for movement between a first position wherein the color imparting means is disposed relative to the translucent element so that the color of the color imparting means is visible through the translucent element, and a second position wherein the color imparting means is remote from the translucent element so that the translucent element does not exhibit the color of the color imparting means.

14. A toy paint brush, comprising:

(a) a handle having a recess defined by an opening;

(b) a translucent member projecting from the handle proximal to the opening;

(c) a color member slidably attached to the handle for movement between a first position wherein a portion of the color member extends from within the recess proximal to the translucent member such that the color of the color member is visible through the translucent member, and a second position wherein the color member is disposed within the recess.

15. The toy paint brush of claim 14, wherein the translucent member is configured as a plurality of bristles, and the color member is configured as a plurality of bristles.

16. A toy paint brush, comprising:

(a) a handle;

(b) a pair of parallel translucent simulated bristle members extending from the handle, the translucent members separated by a gap;

(c) a color member slidably disposed with respect to the bristle member and movable between a first position wherein a portion of the color member is disposed within the gap such that the coloring of the color member is visible through the translucent members, and a second position wherein the color members is remote from the gap.

* * * * *